US006140895A

United States Patent [19]

Dittmann et al.

[11] Patent Number: 6,140,895

[45] Date of Patent: Oct. 31, 2000

[54] ELECTROMAGNETIC RELAY

[75] Inventors: Michael Dittmann; Martin Hanke; Jens Heinrich, all of Berlin, Germany

[73] Assignee: Siemens Aktiengesellschaft, Munich, Germany

[21] Appl. No.: 09/445,361

[22] PCT Filed: Jun. 3, 1998

[86] PCT No.: PCT/DE98/01508

§ 371 Date: Dec. 10, 1999

§ 102(e) Date: Dec. 10, 1999

[87] PCT Pub. No.: WO99/01882

PCT Pub. Date: Jan. 14, 1999

[30] Foreign Application Priority Data

Jun. 30, 1997 [DE] Germany ..... 197 27 863

[51] Int. Cl.[7] ..... H01H 51/22

[52] U.S. Cl. ..... 335/80; 335/124; 335/128

[58] Field of Search ..... 335/78–86, 128, 335/124, 131

[56] References Cited

U.S. PATENT DOCUMENTS 5,608,366 3/1997 Sako et al. ..... 335/78
5,617,066 4/1997 Dittmann et al. ..... 335/78
5,880,653 3/1999 Yamada et al. ..... 335/78
5,880,655 3/1999 Dittmann et al. ..... 335/78

FOREIGN PATENT DOCUMENTS 0 197 391 A2 10/1996 European Pat. Off. .
43 09 618 A1 9/1994 Germany .
195 20 220 C1 11/1996 Germany .
196 15 185 C1 6/1997 Germany .

OTHER PUBLICATIONS

IBM–TDB, vol. 11, No. 11, p. 1587 (1969).

*Primary Examiner*—Lincoln Donovan
*Assistant Examiner*—Tuyen Nguyen
*Attorney, Agent, or Firm*—Hill & Simpson

[57] ABSTRACT

An electromagnetic relay having an armature-spring subassembly that matingly cooperates with a base body having stationary and moving contact elements and stationary terminal elements. The armature-spring subassembly includes a contact arrangement and an armature pivotably mounted to said contact arrangement. The contact arrangement includes two torsion spring ridges and a plurality of contact springs that are attached to both torsion spring ridges.

8 Claims, 2 Drawing Sheets

ELECTROMAGNETIC RELAY

CROSS-REFERENCE TO RELATED APPLICATIONS

This application is the U.S. national phase of PCT application PCT/DE98/01/58 filed Jun. 3, 1998.

BACKGROUND OF THE INVENTION

1. Field of the Prior Art

The invention relates to an electromagnetic relay having a base body made of insulating material, which defines a base level with its bottom and in which terminal tracks for stationary contact elements and terminal elements for stationary and moving contact elements are formed, a swivelling armature, which is arranged above the base body and whose axis of rotation extends parallel to the base level, a contact spring arrangement, which is fixedly connected to the armature via a coveringr made of insulating material, which cooperates with the stationary contact elements of the base body corresponding to the motion of the armature, and which comprises two transverse torsion spring ridges that project from the covering, the contact springs of said contact spring arrangement and the torsion spring ridges being produced from a common plate, a coil, whose axis extends parallel to the base level and perpendicular to the armature's axis of rotation, and whose winding terminal elements penetrate through the base level perpendicularly, and a core that is arranged in the coil axially, at whose ends pole shoes adjoin which are directed toward the armature, these forming at least one working air (Yap with the armature.

2. Description of the Prior Art

European patent application EP 0 197 391 B2 teaches a polarized relay whose armature is borne by a pair of contact springs. The contact springs are movable together with the armature and are respectively fitted in their center region with a rotational arm that extends transversely, 25 which is connected fixedly to a contact piece at a base body. The rotational arms are formed at the contact springs as one piece and represent elastic torsion elements with limited deformation ability. However, horizontally situated torsion spring ridges carry the disadvantage that the torsion spring ridges are also subjected to forces in the vertical of non-negligible magnitude, thereby limiting a constant precision of the air gap between armature and magnet, and, between stationary and working contacts. Furthermore, in the relay taught in EP 0 197 391 B2, the terminal tabs of the torsion spring ridges are curved downward and connected to center contact terminal pins in a recess at the base body. This produces a poorer accessibility to the fixing points of the terminal tabs of the torsion spring ridges at the center contact terminal pieces, thereby making a simple and precise adjustment difficult.

SUMMARY OF THE INVENTION

The object of the invention is to create a reliable and durable armature bearing for a relay, so that a higher precision of the armature movement is guaranteed, in order to increase Pie reliability and the lifetime of the relay. Further objects relate to the miniaturization of the construction and to the reduction of the number of required relay components. Besides this, there is intended to be an ability to simply and rapidly orient the anchor-spring subassembly in the vertical direction relative to the stationary contacts and to the pole shoes, wherein the adjusting of contact pressure, armature lift and response voltage is simplified in assembly. Furthermore, it is intended to mount the armature in an optimally undisplaceable position relative to the stationary contacts and to the other elements of the magnet system, in order to guarantee both a high shock resistance and stable settings of the relay parameters such as armature lift, contact pressure and response voltage.

This is inventively achieved in that the torsion spring ridges are oriented with their sheet levels perpendicular to the base level and are respectively secured at a center contact terminal pin which projects from the base body perpendicular to the base level.

In an advantageous development, connecting surfaces adjoin at the free ends of the torsion spring ridges, which surfaces are bent out from the sheet levels thereof at right angles. These connecting surfaces are formed at the torsion spring ridges as one piece and adjoin at connecting surfaces of the center contact terminal pins. The torsion spring ridges are bent around at right angles at their free ends in the region of the terminal surfaces and are constructed wider. This contributes to a good accessibility of the securing points and to expanded possibilities for adjusting the armature-spring subassembly. The securing of the connecting surfaces at the center contact terminal pins preferably occurs by resistance welding or laser welding. Due to the vertical connecting surfaces which are oriented toward each other, the armature-spring subassembly can be inserted into the base body or into a base from above. When a desired contact spacing has been achieved, the armature-spring subassembly is fixed at the base body, or respectively, the base.

In a polarized embodiment of the relay with at least one permanent magnet that is arranged between the pole shoes parallel to the coil axis, which magnet generates a uniform polarization, it is possible to purposefully preset a monostable behavior of the relay mechanically by securing the armature-spring subassembly in an already deflected position. This may be accomplished by selecting a smaller contact interval at the opener contacts than at the closer contacts, for example.

In another development, the torsion spring ridges and the adjoining connecting surfaces surround the contact terminal pins, resulting in a more favorable position for attaching welding points to the connecting surfaces of the torsion spring ridges and center contact terminal pins. The armature is preferably joined with the contact springs and the covering into an armature-spring subassembly via deformable, vertically standing tabs of the covering of the contact spring arrangement. The armature can be placed on the tabs of the covering. The armature is fixedly connected to the covering and the contact springs consequent to the deformation of the tabs. In an advantageous development, the armature includes a bearing ridge in the region of the armature mounting, which ridge is constructed parallel to the armature's axis of rotation. This reduces the magnetic resistance between the armature and neighboring elements of the magnet system, resulting in a reduction of the losses in the magnetic circuit. This makes possible a further reduction of the power consumption of the relay.

With a view to reducing the number of required relay components, the terminal tracks for the stationary contact elements are produced from a common plate, the appertaining terminal elements being formed by vertically bent terminal tabs of the plate. In addition, a base of the relay which receives the armature-spring subassembly is formed by the base body, wherein the coil is arranged above the base in an insulating covering. The covering of the coil, a frame that has been pushed over the base, and the floor of the base form a compact relay housing.

DESCRIPTION OF THE PREFERRED EMBODIMENT

Figure 1:
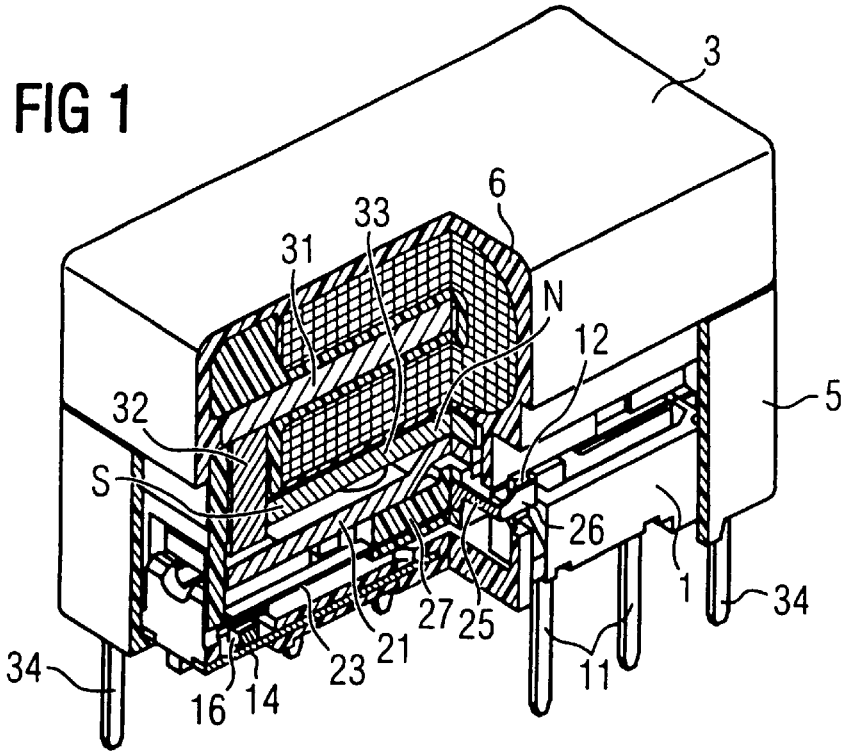
FIG. 1 an inventive relay in a partially sectional perspective view.

FIG. 1 depicts a relay whose housing is formed by the floor of a base body 1, base, by a frame 5 which has been pushed over the base body 1, and by a coil covering 6. Winding terminal elements 34 and contact terminal elements 11 penetrate through the bottom of the base as tear base level of the relay. The winding terminal elements 34 are embedded in flange extensions, which surround the base body 1, of a coil body. An armature-spring subassembly 2 is arranged above the base body 1 and below a coil 3 (see FIG. 2), said subassembly consisting of an armature 21 and two contact springs 23, which are surrounded by an insulating covering 27. Band-shaped torsion spring ridges 25 whose sheet level is oriented perpendicular to the base level project from the spring covering 27 laterally. Connecting surfaces 26, which are formed in one piece, adjoin the torsion spring ridges 25, these being bent from the sheet level of said torsion spring ridges 25 at right angles. The torsion spring ridges 25 and the connecting surfaces 26 form arms which surround the center contact terminal pins 12. On their part, the center contact terminal pins 12 likewise have connecting surfaces 13, which adjoin the connecting surfaces 26 of the torsion spring ridges 25 (see FIG. 2 and FIG. 3). The securing of the connecting surfaces 26 at the connecting surfaces 13 of the center contact,t terminal pins 12 is accomplished via welding.

To reduce the magnetic resistance between armature 21 and a permanent magnet 33 which is arranged thereover between two pole shoes 32, a transverse bearing ridge 22 is formed at the armature in the region of the armature's axis of rotation. The permanent magnet 33 generates a uniform polarization at the ends of the pole shoes 32, which face downward vertically and which adjoin at the free ends of a core 31 that is axially arranged in the coil 3, thereby enabling two bistable working positions of the armature 21. Monostable behavior can be achieved for the relay by a corresponding oblique orientation of the armature-spring subassembly 2 (see FIG. 2).

Figure 3:
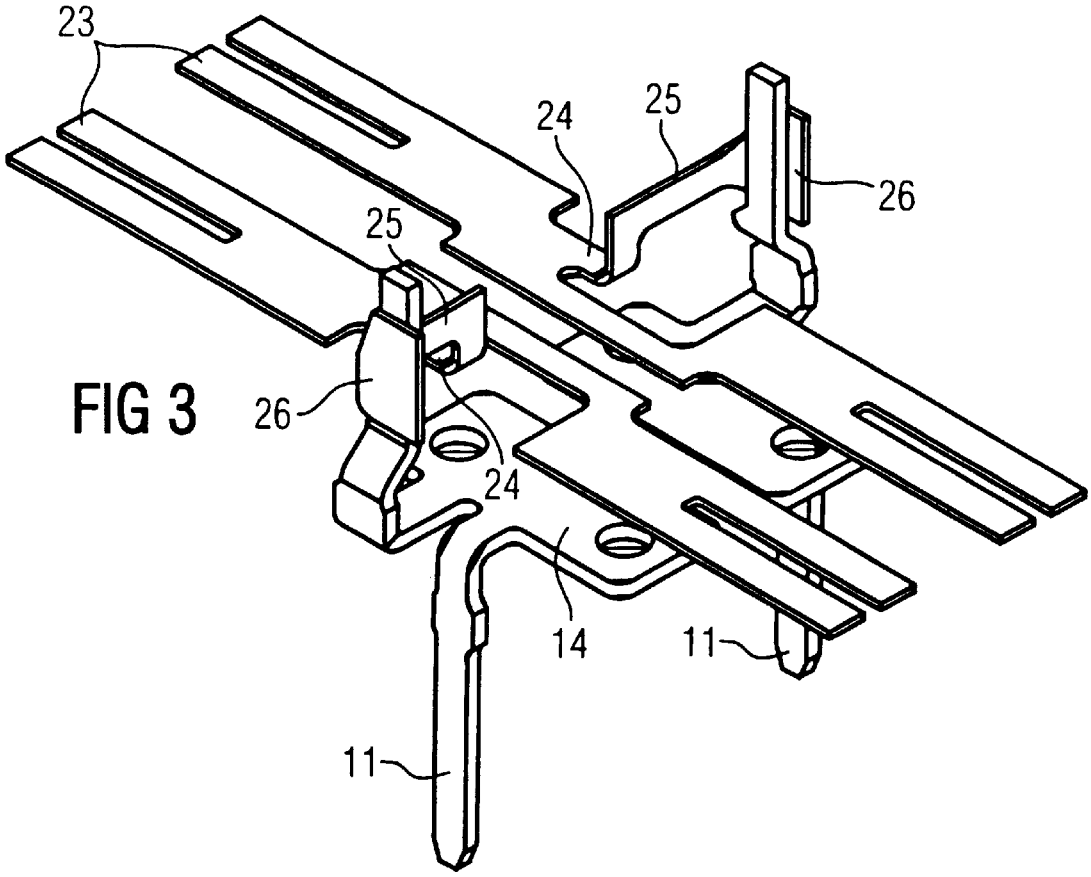
FIG. 3 a contact-spring arrangement and center contact terminals of the relay as depicted in FIG. 1 therefor.

Terminal tracks 14 for stationary contacts, which tracks have been manufactured from a common plate, are embedded in the base 4, which is made of insulating material. The stationary contacts 16 are welded onto the terminal tracks 14. The contact terminal elements 11 are formed by terminal tabs 5 that are bent down (see FIG. 3) of the common plate for the terminal tracks 14. This also applies to the center contact terminals, accordingly, which are likewise for,.red by bent terminal tabs of the terminal tracks 14 (FIG. 3). The center contact terminal pins 12 are formed by terminal tabs which are bent away in an upward direction, while the terminal elements 11 of the center contacts are bent away in a downward direction and project through the bottom of the base 4.

Figure 2:
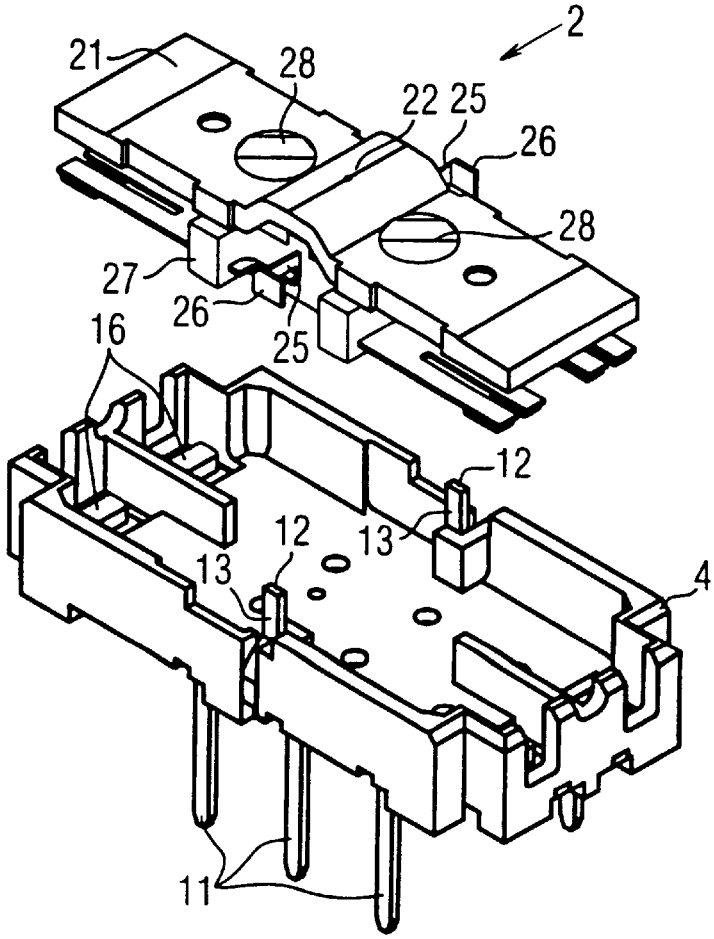
FIG. 2 a base and an armature-spring subassembly of the relay as depicted in FIG. 1, in an exploded view.
Figure 4:
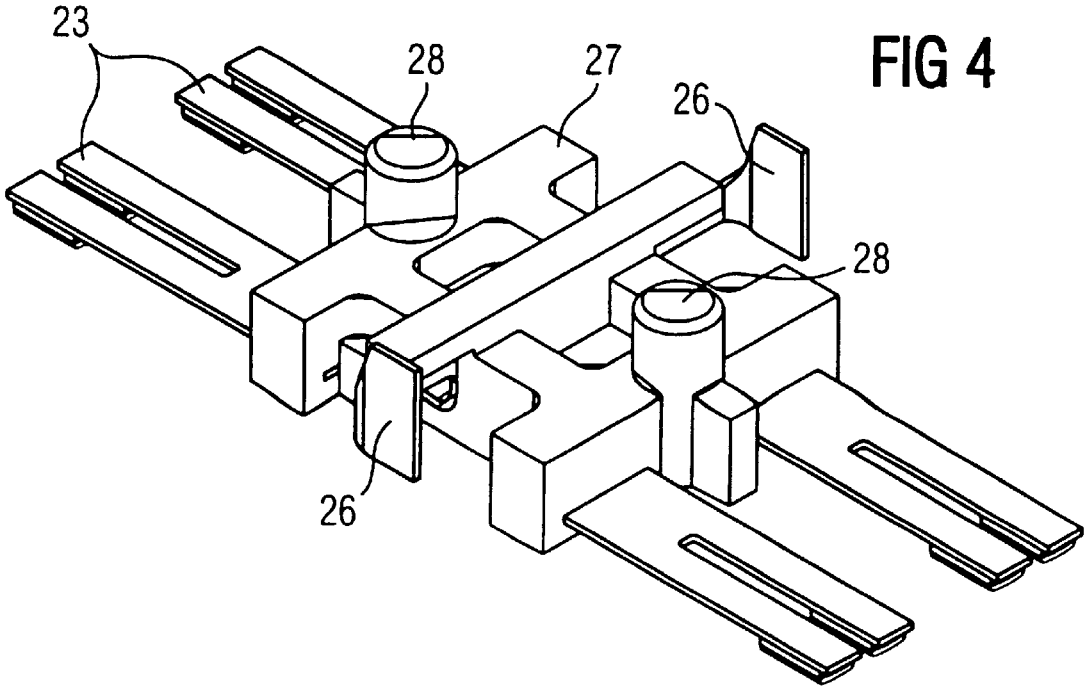
FIG. 4 the contact spring arrangement with appertaining covering.

It can be seen with the aid of FIGS. 2 and 4 that the armature-spring subassembly 2 contains two separate contact springs 23 which extend parallel to each other and which bear switch contacts which are welded on at their ends. The contact springs 23 are reproduced from a common plate and surrounded by a covering 27 made of insulating material. Since the connecting surfaces 26 of the torsion ridges 25 and the connecting surfaces 26 of the center contact terminal pins 12 are situated adjacently in a plane that is perpendicular to the base level, the armature-spring Subassembly 2 can be inserted into the base 4 from above in the assembly process. When a desired contact spacing has been achieved, the connecting surfaces 26 are welded to the connecting surfaces 13 of the center contact terminal pins 12. The spring covering 27 has deformable fixing tabs 28 which stand upright vertically and on which the armature 21 is placed. By deforming these fixing tabs 28, the armature 21 is fixedly connected to the contact springs 23 and to the spring covering 27, forming an armature-spring subassembly 2. In addition, the contact springs 23 are slotted at their free ends, thereby increasing their flexibility.

FIG. 3 illustrates the formation of the vertically standing torsion spring ridges 25. In their center region, the leaf springs 23 comprise parallel lateral arms, at whose free ends a torsion spring ridge 25 adjoins, which is led outward at a right angle. The torsion spring ridges 25 are bent around in an upward direction, thereby producing the perpendicular orientation of their sheet level relative to the base level. To prevent the torsion spring ridges 25 from being subjected merely to bending in the transition region between the lateral arms 24 and the torsion spring ridges 25, the contact springs 23 are surrounded with a covering in their center region to such an extent that only the free end portions of the contact springs 23 and the vertically standing torsion spring ridges 25 project from the covering 27 (see FIG. 4).

Since the leaf-spring-type spring ridges 25 are subjected to torsion stresses, it is possible to achieve a higher spring rate independent of the thickness of the contact springs 23 in this way than with spring ridges that are subjected to bending. Due to the high rigidity of the torsion spring ridge 25 in the vertical, the spacing between the armature 21 and the permanent magnet 33 is constant to the greatest extent possible. In particular, the vertically standing torsion spring ridges 5 produce a very high shock resistance of the relay.

Furthermore, the desired contact spacing can be set rapidly and simply in the assembly process due to the good accessibility of the securing point of the torsion spring ridges at the center contact terminal pins 12. Beyond this, it is possible to set the desired armature lift in the assembly process in a simple manner in that it is possible to push the coil 3 with the permanent magnet 33 onto the base subassembly until the desired armature lift is set. Here, the coil 3 clamps onto the base 4 using flange extensions of the coil body that are oriented downward.

Although modifcations and changes may be suggested by those skilles in the art, it is the intention of the inventions to embody within the patent warranted hereon all changes and modifications as reasonably and properly come within the scope of their contribution to the art.

What is claimed is:

1. An electromagnetic relay comprising:

a base body defining a base level and including a base body insulating material, said base body having a floor, a plurality of center contact terminal pins, each of said center contact terminal pins projecting from said base body in a center contact terminal pin direction, and a plurality of terminal tracks being mounted to said base body for supporting a plurality of stationary contact elements, a plurality of moving contact elements and a plurality of terminal elements;

a contact spring arrangement and an armature being pivotably mounted to said contact spring arrangement at a spring covering for forming an armature-spring subassembly, said subassembly matingly cooperating with each of said stationary contact elements of said base body, said armature being pivotably mounted about an armature pivot axis, said armature pivot axis extending in an armature pivot axis direction, said contact spring arrangement including two torsion spring ridges and a plurality of contact springs being connected to both of said torsion spring ridges, both of said torsion spring ridges projecting through said spring covering, said two torsion spring ridges extending along at least a portion of said armature pivot axis and being secured to each of said respective center contact terminal pins, said two torsion spring ridges and each of said contact springs being manufactured from a common plate;

a coil being mounted above said base body and extending along at least a portion of said base body, said coil including a plurality of coil terminal elements, each of said coil terminal elements penetrating through said base level in a perpendicular direction relative to said base level;

a core being axially disposed within said coil, said core having two core ends, both of said core ends including a pole shoe, both of said pole shoes extending to said armature for providing at least one working gap therein.

2. An electromagnetic relay according to claim 1 wherein each of said center contact terminal pins has a center contact terminal pin connecting surface and both of said two torsion spring ridges have a torsion spring ridge end, said torsion spring ridge end including a torsion spring ridge connecting surface for mating cooperatively with each of said respective center contact terminal pin connecting surfaces, both of said torsion spring ridge connecting surfaces extend in a perpendicular direction relative to said armature pivot axis and both of said torsion spring ridges connecting surfaces are oriented perpendicular to said base level.

3. An electromagnetic relay according to claim 2 wherein both of said torsion spring ridge connecting surfaces surround each of said respective center contact terminal pin connecting surfaces.

4. An electromagnetic relay according to claim 1 wherein said spring covering includes a plurality of vertically standing journals for connecting said armature to each of said contact springs.

5. An electromagnetic relay according to claim 1 wherein said armature includes a bearing ridge, said bearing ridge extends along at least a portion of said armature pivot axis.

6. An electromagnetic relay according to claim 1 wherein said terminal tracks and each of said stationary contact elements and each of said stationary terminal elements are manufactured from a common terminal track plate, each of said stationary terminal elements include a terminal tab, said terminal tab being angled in a downward direction relative to said terminal track plate.

7. An electromagnetic relay according to claim 1 wherein a plurality of bar-shaped permanent magnets are axially disposed between said two pole shoes for generating a uniform polarization at both of said pole shoes.

8. An electromagnetic relay according to claim 1 wherein said base body includes a base for accepting said armature-spring subassembly, wherein said coil being disposed above said base and being surrounded by a coil covering, said coil covering having a coil covering insulating material, and wherein a frame surrounds said base, said frame and said coil covering provide a housing for said electromagnetic relay.

* * * * *